US007559381B2

(12) United States Patent
Lin

(10) Patent No.: US 7,559,381 B2
(45) Date of Patent: Jul. 14, 2009

(54) SURFACE TEXTURES FOR EARTH BORING BITS

(75) Inventor: Chih C. Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 116 days.

(21) Appl. No.: 11/760,892

(22) Filed: Jun. 11, 2007

(65) Prior Publication Data

US 2007/0284150 A1 Dec. 13, 2007

Related U.S. Application Data

(60) Provisional application No. 60/812,539, filed on Jun. 9, 2006.

(51) Int. Cl.
*E21B 10/22* (2006.01)

(52) U.S. Cl. ..... 175/372; 384/93

(58) Field of Classification Search ..... 175/371, 175/372; 384/93
See application file for complete search history.

(56) References Cited

U.S. PATENT DOCUMENTS 4,248,485 A 2/1981 White et al.
4,514,098 A * 4/1985 Ippolito ..... 384/95
4,619,534 A 10/1986 Daly et al.
4,620,803 A 11/1986 Vezirian
6,068,070 A 5/2000 Scott
6,209,185 B1 4/2001 Scott
2005/0054276 A1 3/2005 Shamshidov et al.

FOREIGN PATENT DOCUMENTS

WO WO 01/66982 A1 9/2001

OTHER PUBLICATIONS

"A Laser Surface Textured Hydrostatic Mechanical Seal", by Etsion et al. Dept. of Mechanical Eng. Technion Haifa 32000, Israel, Tribology Transactions, V.45 (2002), p. 430-434.
"Experimental Investigation of Laser Surface Textured Parallel Thrust Bearings", Etsion et al. Dept. of Mech. Eng. Haifa 32000, Israel, Tribology Ltrs. Plenum Publ. Sep. 14, 2003.
"Analytical and Experimental Investigation of Laser-Textured Mechanical Seal Faces", by Etsion, et al. Haifa 32000, Israel, Tribology Transactions, V.42 (1999) p. 511-516.

* cited by examiner

*Primary Examiner*—William P Neuder
(74) *Attorney, Agent, or Firm*—Bracewell & Giuliani LLP

(57) ABSTRACT

A texture pattern is applied to bearing surfaces of earth-boring bits, especially the bearings of earth boring bits of the roller cutter variety. The textured surface that may be applied to either or both sides of the thrust washer faces, bearing faces, inlays, or thrust shoulders, or a combination thereof.

22 Claims, 7 Drawing Sheets

Fig. 2
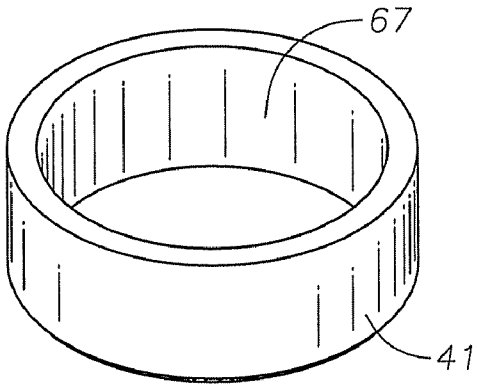
Fig. 3
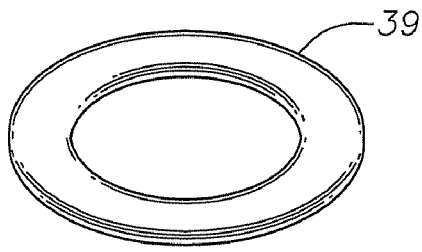
Fig. 4
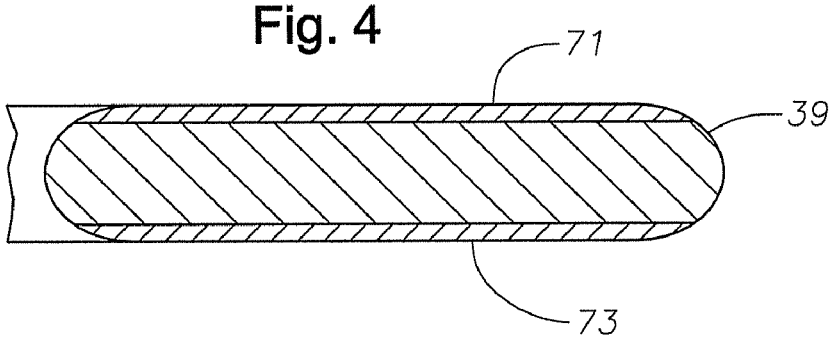
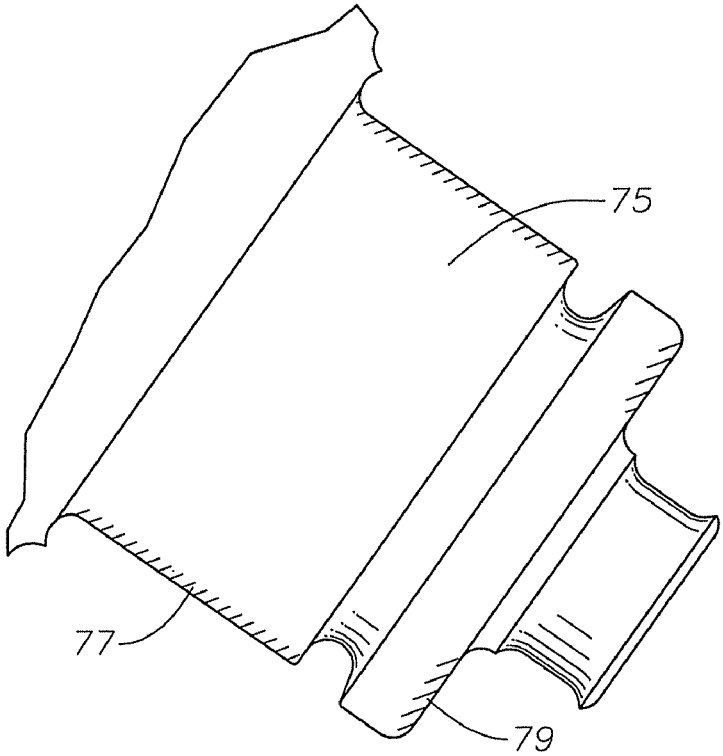
Fig. 5

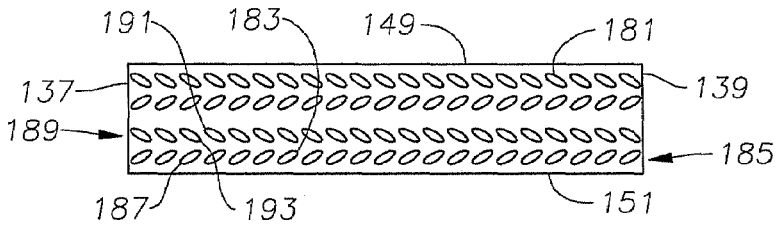
Fig. 18
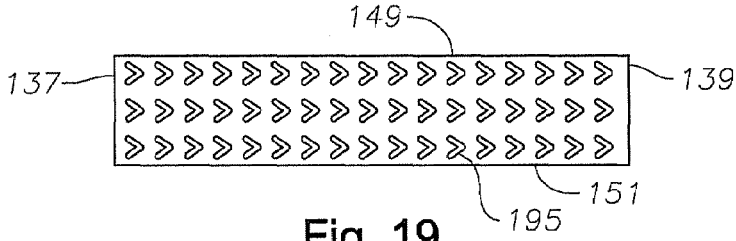
Fig. 19
Fig. 20
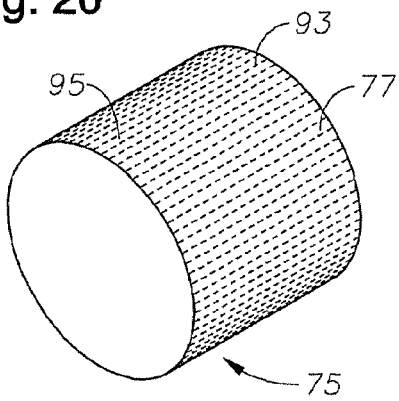
Fig. 21
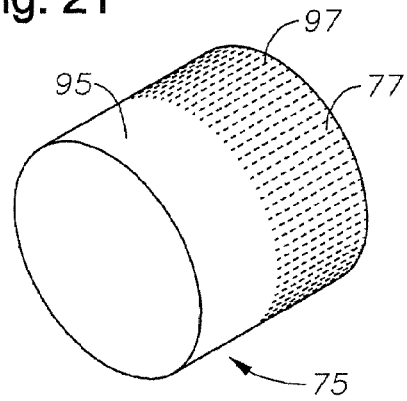

Fig. 22
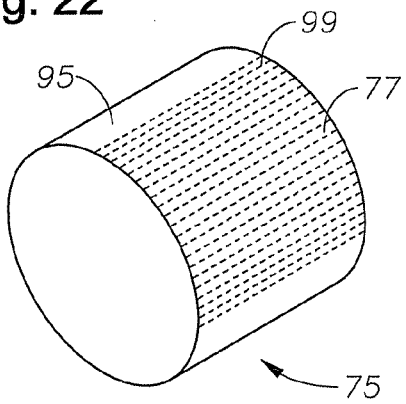
Fig. 23
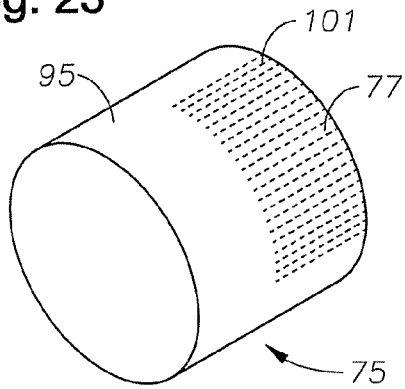
Fig. 24
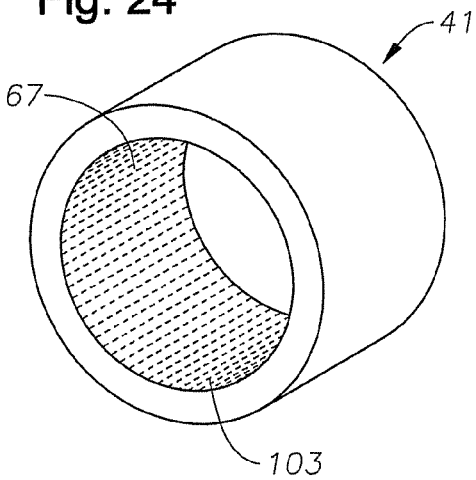
Fig. 25
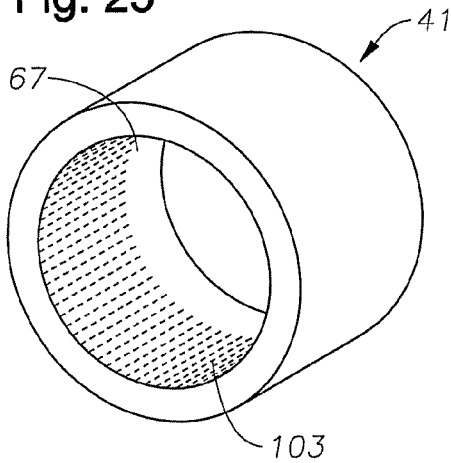
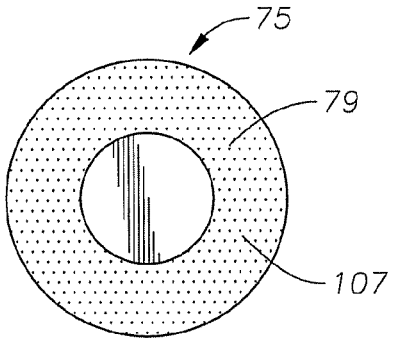
Fig. 26
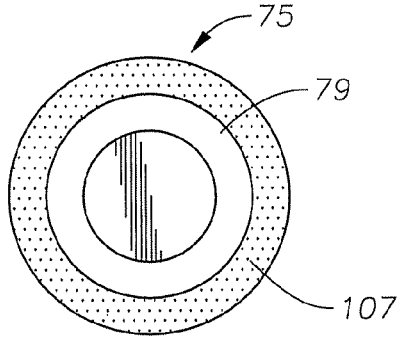
Fig. 27

SURFACE TEXTURES FOR EARTH BORING BITS

CROSS-REFERENCE TO RELATED APPLICATION

This application claims priority to provisional application 60/812,539, filed Jun. 9, 2006.

FIELD OF THE INVENTION

This invention relates in general to earth-boring bits, especially the bearings of earth boring bits of the roller cutter variety. More particularly, the present invention relates to applying a surface texture to improve the performance of the bearings.

DESCRIPTION OF THE PRIOR ART

In drilling boreholes in earthen formations by the rotary method, earth-boring bits typically employ at least one rolling cone cutter, rotatably mounted thereon. The bit is secured to the lower end of a drillstring that is rotated from the surface or by downhole motors. The cutters mounted on the bit roll and slide upon the bottom of the borehole as the drillstring is rotated, thereby engaging and disintegrating the formation material. The rolling cutters are provided with teeth that are forced to penetrate and gouge the bottom of the borehole by weight from the drillstring.

As the cutters roll and slide along the bottom of the borehole, the cutters and the shafts on which they are rotatably mounted, are subjected to large static loads from the weight on the bit, and large transient or shock loads encountered as the cutters roll and slide along the uneven surface of the bottom of the borehole. Thus, most earth-boring bits are provided with precision-formed journal bearings and bearing surfaces, as well as sealed lubrication systems to increase drilling life of bits. These bearings must operate effectively in significant misaligmnent configurations under these high load and low speed conditions.

The bearing surfaces include a thrust shoulder formed on the bearing pin perpendicular to the axis of the bearing pin. A mating thrust shoulder is formed in the cavity of the cone. A partially cylindrical journal bearing surface is formed around part of the bearing pin for engaging a mating surface in the cavity of the cone. The lubrication systems typically are sealed to avoid lubricant loss and to prevent contamination of the bearings by foreign matter such as abrasive particles encountered in the borehole.

In the past, inlays of a hard material have been placed on the thrust shoulder and journal bearing surface. However, there is a demand for new technology to improve the performance of the bearings in such a severe and unique operating environment.

SUMMARY OF THE INVENTION

In this invention a texture pattern is applied to bearing surfaces of earth-boring bits, especially the bearings of earth boring bits of the roller cutter variety. The textured surface that may be applied to either or both sides of the thrust washer faces, bearing faces, inlays, or thrust shoulders, or a combination thereof. The surface texture may be applied directly to the metal surface of the component either before or after the component has undergone final heat treatment, hardening, and finish machining, although in the preferred embodiment, the surface texture would be added after the final machining of the component.

The depth of the pattern of the textured surface may be in the range of 2-30 microns and the width or diameter of the pattern of the textured surface may be in the range of 10 to 1000 microns. The surface area of the component to which a surface texture is applied, in the width or length or both directions, can be 10% to 100% of the total functional surface area of the component. The density of the textured pattern, defined as surface area covered by the recesses of the pattern divided by the area of the component to which a surface texture is applied, may be 10% to 70%. The textured surface may be formed by mechanical cutting, embossing, chemical etching, laser engraving, electro-spark techuique, vibro-chemical methods, or vibro-mechanical methods.

The orientation and the size and shape of the surface texture have a significant influence on its effectiveness on bearing performance. In one preferred embodiment, the grooves of the surface texture run parallel to the direction of the flow of the lubricant. This will help prevent side leakage of the lubricant. In another preferred embodiment the grooves of the surface texture run perpendicular to the direction of the flow of the lubricant, which will generate extra hydrodynamic force. When considering the rotating components, the preferred embodiment would be to apply the surface texture to the rotating surface. Alternatively, when applying the surface texture to improve shock absorption, the preferred embodiment is to apply the texture to the stationary surface. A combination of different texture orientations, density, and shapes can be used in different regions of the same functional surface to maximize the lubrication performance. For example, near the edge of the journal, the long axes of the texture might be oriented along the flow direction to minimize side leakage, while in the middle region of the bearing, the long axes of the texture runs perpendicular to the flow direction to increase hydrodynamic lift force. Similarly, in area where significant impact force is expected, the texture area density might be increased.

BRIEF DESCRIPTION OF THE DRAWINGS

FIG. 2 is a perspective view of a journal bearing insert of the bit of FIG. 1.

FIG. 3 is a perspective view of a thrust washer of the bit of FIG. 1.

FIG. 4 is a schematic sectional view of a portion of the thrust washer of FIG. 3.

FIG. 5 is a side view of part of a bearing pin of an alternate embodiment.

FIG. 18 is a schematic view of an alternative embodiment of a texture pattern for bearing surfaces.

FIG. 19 is a schematic view of an alternative embodiment of a texture pattern for bearing surfaces.

FIG. 20 is a schematic perspective view of a journal bearing.

FIG. 21 is a schematic perspective view of an alternative embodiment of a journal bearing.

FIG. 22 is a schematic perspective view of an alternative embodiment of a journal bearing.

FIG. 23 is a schematic perspective view of an alternative embodiment of a journal bearing.

FIG. 24 is a schematic perspective view of a bearing insert.

FIG. 25 is a schematic perspective view of an alternative embodiment of a bearing insert.

FIG. 26 is a schematic front view of a thrust shoulder.

FIG. 27 is a schematic front view of an alternative embodiment of a thrust shoulder.

DETAILED DESCRIPTION OF THE INVENTION

Figure 1:
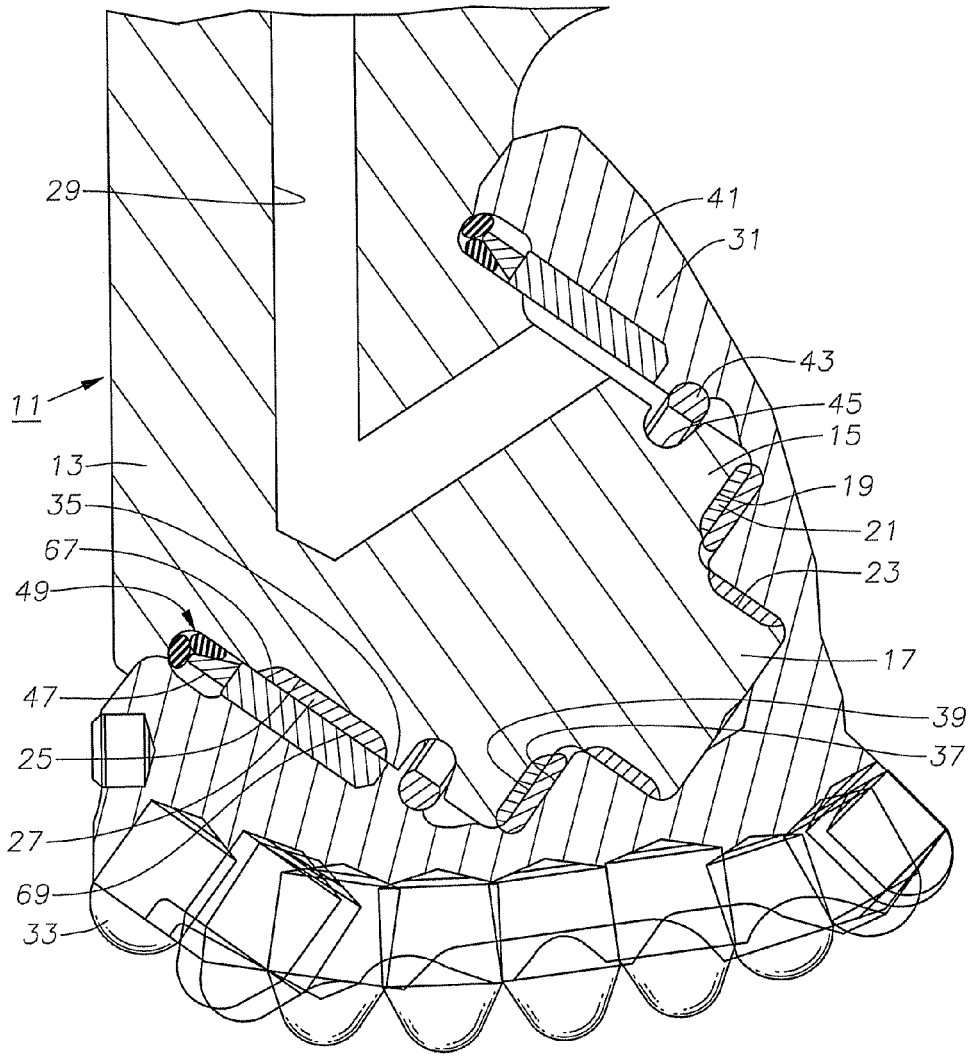
FIG. 1 is a sectional view of a portion of an earth-boring bit constructed in accordance with this invention.

Referring to FIG. 1, bit 11 has at least one bit leg 13 and normally three. Each bit leg 13 has a bearing pin 15 that extends downward and inward toward an axis of rotation of bit 11. Bearing pin 15 has a cylindrical nose 17 on an inner end that is of lesser diameter than remaining portions of bearing pin 15. An inward facing annular thrust shoulder 19 surrounds nose 17. Thrust shoulder 19 is located in a plane perpendicular to an axis of bearing pin 15. In this embodiment, thrust shoulder 19 optionally has an inlay 21 of a hard, wear resistant material. Similarly nose 17 may have an inlay 23 of the same wear resistant material on its cylindrical exterior.

Bearing pin 15 has a partially cylindrical journal bearing surface 25 that extends around its lower side. In this embodiment, an optional inlay 27 of a hard wear resistant material is located in journal bearing surface 25. Since the thrust imposed on bit 11 is downward, inlay 27 does not extend to the upper side of bearing pin 15. Inlays 21 and 23 could be omitted if desired. A lubricant passage 29 extends through bit leg 13 and bearing pin 15 to the upper side of bearing pin 15. A pressure compensator (not shown) supplies pressurized lubricant to passage 29.

A cutter or cone 31 mounts rotatably to bearing pin 15. Cone 31 has a plurality of teeth 33 on its exterior. FIG. 1 shows teeth 33 from all three cones 31 of bit 11 rotated into a single plane. Teeth 33 may be hard metal inserts pressed into mating holes in the body of cone 31, as shown. Alternately, they may be steel teeth milled into the exterior of cone 31.

Cone 31 has a central cavity 35 for rotatably mounting on bearing pin 15. Cavity 35 has a thrust shoulder 37 that is perpendicular to the axis of cone 31 for mating with bearing pin thrust shoulder 19. A thrust washer 39 is located between thrust shoulders 19 and 37. In the preferred embodiment, thrust washer 39 is not fixed to either thrust shoulder 19 or 37, although it could be brazed or welded to one of the shoulders 19 or 37 or made part of shoulder 19.

A bearing insert 41 is located in the cavity of cone 31 in this embodiment to serve as part of a seal assembly. Bearing insert 41 rotates with cone 31 and slidingly engages a rigid ring 47 in this embodiment. Ring 47 is also formed preferably of a hardened metal. A retainer ring 43 extends around cavity 35 in engagement with a retaining groove 45 to hold cone 31 on bearing pin 15. Another type of retainer uses balls. A seal assembly seals lubricant within the bearing spaces between bearing pin 15 and cone 31.

The improved performance of the earth boring bit, in accordance with the present invention, involves applying a textured surface to one or more bearing surfaces. The textured surface can provide additional lifting forces, thereby increasing the film thickness of the lubricant. The surface to which the surface texture will be applied may be a standard alloy steel such as bearing steel or one containing 0.15% C, 0.8% Mn, 0.55% Cr, 0.85% Ni and 0.55% Mo or other similar material.

The texture may be applied to the surface before any heat treating or hardening of the component has taken place. However, the heat treating or hardening process may deform the texture pattern to some degree. The texture may be applied to the surface after the component has undergone heat treating or hardening. In this case, the tools used to apply the texture to the surface will have to be capable of forming the texture on the hardened surface. Applying the texture after all machining, heat treating, and hardening procedures have been completed will result in the most accurately formed texture pattern.

Textures surfaces will enhance lubrication by retaining some of the lubricant during rotation of cutter 31 (FIG. 1). Having textured surfaces according to the present invention increases the average film thickness between the sliding surfaces over earth boring bit prior-art leading to reduced wear. Additionally having a textured surface will lower the operating temperature, thereby reducing thermal seizure and thermal assisted crack propagation. The textured surface, according to recent research work, has the benefit of reducing the damage accrued under start and stop conditions. For surfaces undergoing compressive forces, the textured surfaces will trap lubricant and provide hydrostatic pressure generation. Furthermore, the textured surfaces serve as a lubricant reservoir to help lubricating the surface, a damper to absorb shock loads, and a cavity for debris entrapment.

Applying textured surfaces according to the present invention result in an earth-boring bit having longer operational life. Earth boring bits are subject to extreme pressures and temperatures, and the ability of the bearing surfaces to operate longer than prior-art permits retention of lubricant for longer periods of time, thus resulting in an earth-boring bit having a higher load capacity and an increased life and therefore more economical operation.

Bearing insert 41 has a bearing face 67 which corresponds to a bearing face 69 of inlay 27. A textured surface is applied to at least one of the bearing faces 67 or 69. Returning to FIG. 1, a textured surface may also be applied to inlays 21 and 23, thrust shoulder 37 and thrust washer 39.

As illustrated in FIG. 2, a textured surface is applied to the inner surface 67 of bearing insert 41. FIG. 3 depicts thrust washer 39, which may have a textured surface on one or both sides 71, 73, as further illustrated in FIG. 4.

In the embodiment of FIG. 5, bearing pin 75 does not have a thrust shoulder inlay 21 or journal bearing inlay 27 as in FIG. 1. Instead, a textured surface is directly applied to the journal bearing 77 of bearing pin 75. A textured surface is directly applied to the thrust shoulder 79 of bearing pin 75. The textured surfaces on journal bearing 77 and thrust shoulder 79 replace inlays 21 and 27.

FIGS. 6 through 19, illustrate alternative embodiments of the textured surface that may be applied to either or both sides 71, 73 (FIG. 4) of thrust washer 39, bearing faces 67, 69 (FIG. 1), inlays 21 and 23 (FIG. 1), and thrust shoulder 37 (FIG. 1). The flow of fluid across the textured surface in each of FIGS. 6 through 19 is preferably from end 137 to end 139. In each case, the pattern may have a rectangular, V-shaped, or semi-circular cross-section.

Figure 7:
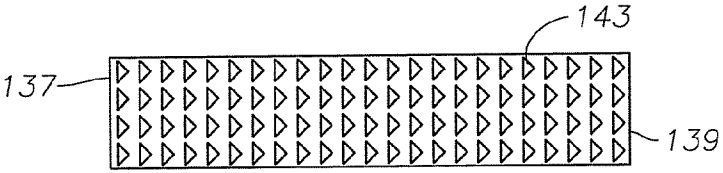
FIG. 7 is a schematic view of an alternative embodiment of a texture pattern for bearing surfaces.
Figure 9:
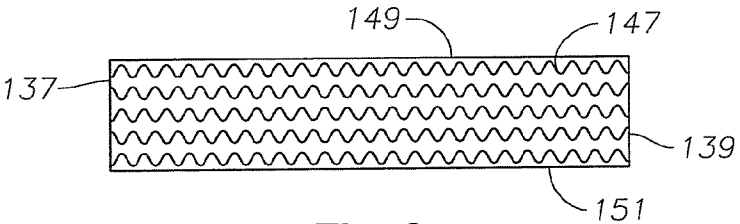
FIG. 9 is a schematic view of an alternative embodiment of a texture pattern for bearing surfaces.
Figure 6:
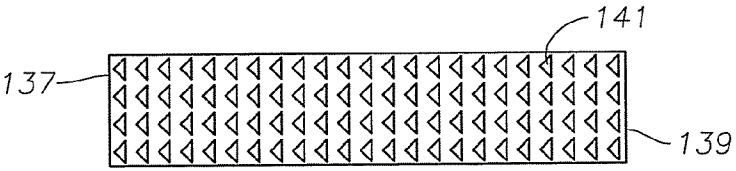
FIG. 6 is a schematic view of an embodiment of a texture pattern for bearing surfaces.
Figure 8:
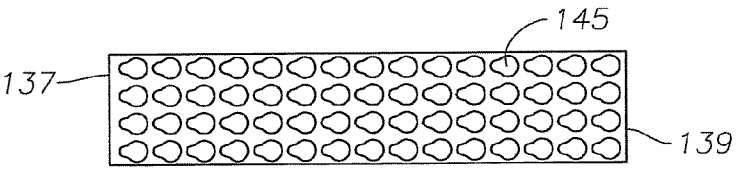
FIG. 8 is a schematic view of an alternative embodiment of a texture pattern for bearing surfaces.
Figure 10:
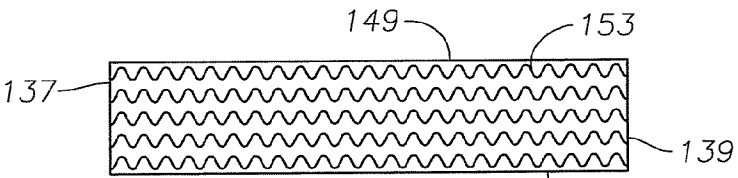
FIG. 10 is a schematic view of an alternative embodiment of a texture pattern for bearing surfaces.

FIGS. 6 and 7 illustrate an embodiment of a textured surface that has a regular pattern of triangular shaped recesses 141, 143. The apex of triangular recesses 141 of FIG. 6 point towards end 137 and the apex of triangular recesses 143 of FIG. 7 point towards end 139. FIG. 8 illustrates an embodiment of a textured surface that has a regular pattern of pear shaped recesses 145. In this embodiment, the smaller end of pear shaped recesses 145 point towards end 137. FIG. 9 illustrates an embodiment of a textured surface that has series of sinusoidal grooves 147 with axis that run parallel to sides 149 and 151 of such textured surface. Sinusoidal grooves 147 are offset from each other such that the troughs and peaks of each sinusoidal groove 147 do not line up between sides 151 and 149. FIG. 10 illustrates an embodiment of a textured surface that has series of sinusoidal grooves 153 with axis that run parallel to sides 149 and 151 of such textured surface. The troughs and peaks of each sinusoidal groove 147 line up between sides 151 and 149.

Figure 11:
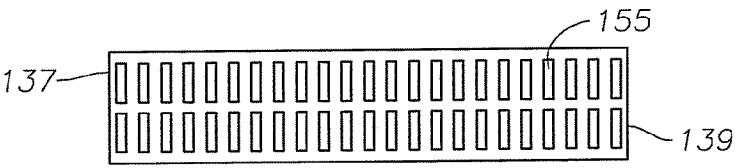
FIG. 11 is a schematic view of an alternative embodiment of a texture pattern for bearing surfaces.
Figure 13:
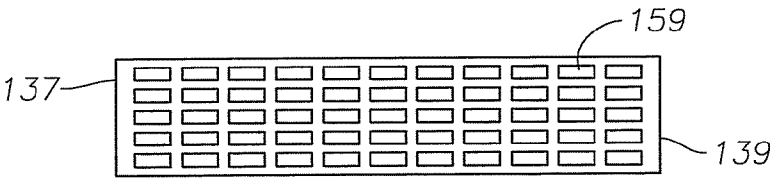
FIG. 13 is a schematic view of an alternative embodiment of a texture pattern for bearing surfaces.
Figure 12:
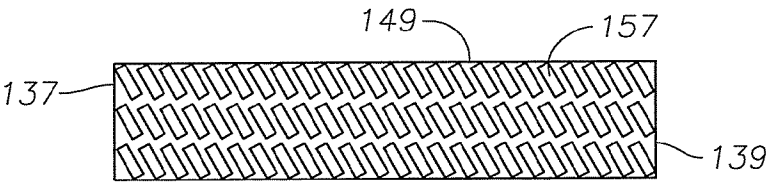
FIG. 12 is a schematic view of an alternative embodiment of a texture pattern for bearing surfaces.
Figure 14:
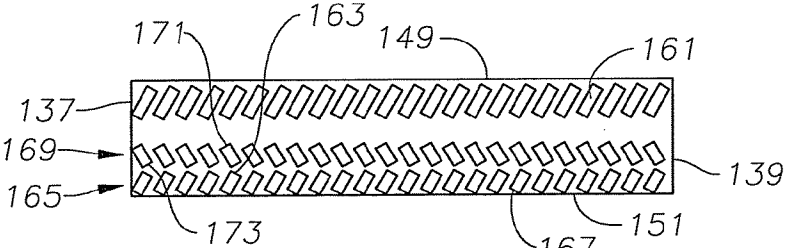
FIG. 14 is a schematic view of an alternative embodiment of a texture pattern for bearing surfaces.

FIG. 11 illustrates an embodiment of a textured surface that has a regular pattern of rectangular shaped recesses 155. The long axes of rectangular recesses 155 are parallel to ends 137 and 139. FIG. 12 illustrates an embodiment of a textured surface that has a regular pattern of rectangular shaped recesses 157. The long axes of rectangular recesses 157 are neither parallel to ends 137 and 139 nor parallel to sides 149 and 151. FIG. 13 illustrates an embodiment of a textured surface that has a regular pattern of rectangular shaped recesses 159. The long axes of rectangular recesses 159 are perpendicular to ends 137 and 139. FIG. 14 illustrates an embodiment of a textured surface that has a regular pattern of rectangular shaped recesses 161. Rectangular shaped recesses 161 are set in a herring bone pattern. The long axes of each rectangular recess 161 is neither parallel to ends 137 and 139 nor parallel to sides 149 and 151. The short side 163 of rectangular shaped recesses 161 in row 165 is closer to both side 149 and end 139 of the textured surface than short side 167 of rectangular shaped recesses 161 in row 165. Row 169 of rectangular shapes recesses 161 is adjacent to row 165. In row 169, the short side 171 of rectangular shaped recesses 161 is closer to both side 149 and end 137 of the textured surface than short side 173 of rectangular shaped recesses 161 in row 169.

Figure 15:
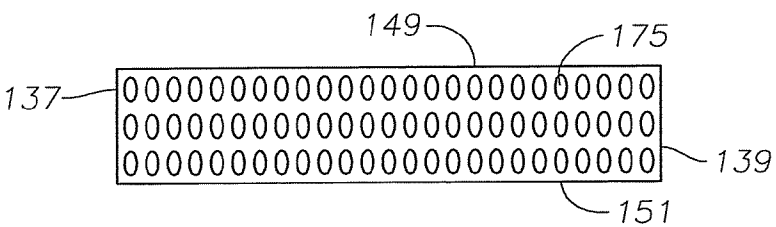
FIG. 15 is a schematic view of an alternative embodiment of a texture pattern for bearing surfaces.
Figure 17:
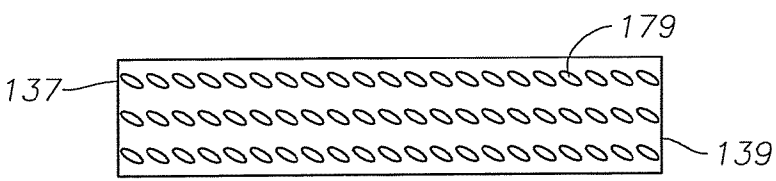
FIG. 17 is a schematic view of an alternative embodiment of a texture pattern for bearing surfaces.
Figure 16:
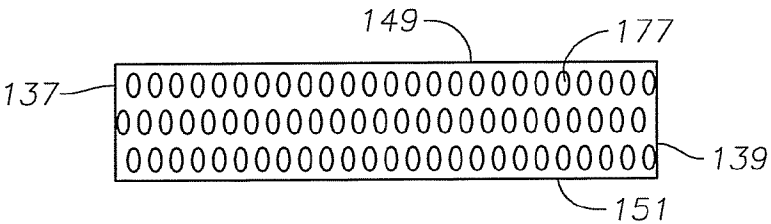
FIG. 16 is a schematic view of an alternative embodiment of a texture pattern for bearing surfaces.

FIG. 15 illustrates an embodiment of a textured surface that has a regular pattern of elliptical shaped recesses 175. The long axes of elliptical recesses 175 are parallel to ends 137 and 139. Elliptical shaped recesses 175 line up between sides 149 and 151. FIG. 16 illustrates an embodiment of a textured surface that has a regular pattern of elliptical shaped recesses 177. The long axes of elliptical recesses 177 are parallel to ends 137 and 139. Elliptical shaped recesses 177 are offset such that they do not line up between sides 149 and 151. FIG. 17 illustrates an embodiment of a textured surface that has a regular pattern of elliptical shaped recesses 179. The long axes of elliptical recesses 179 are neither parallel to ends 137 and 139 nor parallel to sides 149 and 151.

FIG. 18 illustrates an embodiment of a textured surface that has a regular pattern of elliptical shaped recesses 181. Elliptical shaped recesses 181 are set in a herring bone pattern. The long axes of each elliptical recess 181 is neither parallel to ends 137 and 139 nor parallel to sides 149 and 151. The one end 183 of elliptical shaped recesses 181 in row 185 is closer to both side 149 and end 139 of the textured surface than the other end 187 of elliptical shaped recesses 161 in row 185. Row 189 of elliptical shapes recesses 181 is adjacent to row 185. In row 189, one end 191 of elliptical shaped recesses 181 is closer to both side 149 and end 137 of the textured surface than the other end 193 of elliptical shaped recesses 181 in row 189.

FIG. 19 illustrates an embodiment of a textured surface that has a regular pattern of boomerang or V shaped recesses 195. In this embodiment, the apex of each boomerang or V shaped recess 195 points towards end 139.

FIGS. 20 through 23, illustrate alternative embodiments of the textured surface that may be applied to journal bearing 77 of bearing pin 75. In FIGS. 20 through 23 the load bearing surface of bearing pin 75 is shown at the top. Referring to FIG. 20, in one embodiment the textured surface 93 of journal bearing 77 may cover the entire outer surface 95 of journal bearing 77. In alternative embodiments, it may be as effective and more economical to only partially apply surface texture 93 to only part of the outer surface 95 of journal bearing 77. Referring to FIG. 21, one alternative embodiment would be to apply textured surface 97 all of the way around the circumference of the outer surface 95 of journal bearing 77 but not over the whole length of journal bearing 77. Referring to FIG. 22, another alternative embodiment would be to apply textured surface 99 over the whole length of journal of the outer surface 95 of journal bearing 77 but only over a portion of the circumference of journal bearing 77. Referring to FIG. 23, another alternative embodiment would be to apply textured surface 101 over part of the length of outer surface 95 of journal bearing 77 over a portion of the outer circumference of journal bearing 77.

FIGS. 24 and 25, illustrate alternative embodiments of the textured surface that may be applied to bearing face 67 of bearing insert 41. Referring to FIG. 24, in one embodiment the textured surface 103 of bearing face 67 may cover the entire bearing face 67. In alternative embodiments, it may be as effective and more economical to only partially apply surface texture 103 to only part of bearing face 67. Referring to FIG. 25, an alternative embodiment would be to apply textured surface 105 over the entire inner circumference of bearing face 67 but only over a portion of the length of bearing face 67.

Figure 28:
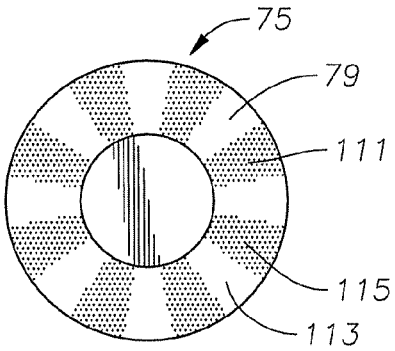
FIG. 28 is a schematic front view of an alternative embodiment of a thrust shoulder.
Figure 29:
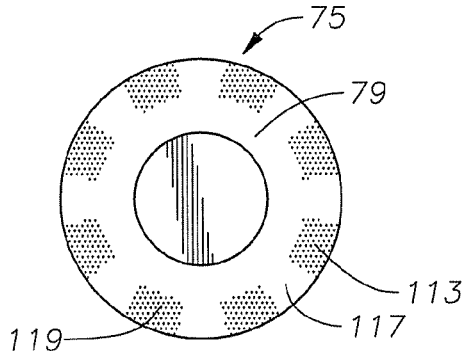
FIG. 29 is a schematic front view of an alternative embodiment of a thrust shoulder.

FIGS. 26 through 29, illustrate alternative embodiments of the textured surface that may be applied to the thrust shoulder 79 of bearing pin 75. Referring to FIG. 26, in one embodiment the textured surface 107 of thrust shoulder 79 may cover the entire surface of thrust shoulder 79. In alternative embodiments, it may be more effective and economical to only partially apply surface texture 107 to only part of thrust shoulder 79. Referring to FIG. 27, an alternative embodiment would be to apply textured surface 109 to thrust shoulder 79 in a concentric circular pattern that does not cover the complete width of thrust shoulder 79. Referring to FIG. 28, another alternative embodiment would be to apply textured surface 111 to thrust shoulder 79 in sections of the same width as thrust shoulder 79, around thrust shoulder 79 such that there are segments 113 that do not have a textured surface and segments 115 that do have a textured surface. Referring to FIG. 29, another alternative embodiment would be to apply textured surface 113 to thrust shoulder 79 in a broken concentric circular pattern that does not cover the complete width of thrust shoulder 79 such that there are segments 117 that do not have a textured surface and segments 119 that do have a textured surface.

Figure 30:
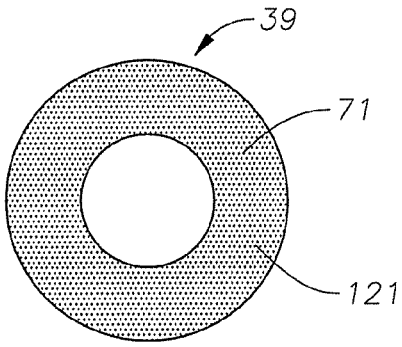
FIG. 30 is a schematic front view of an embodiment of a thrust washer.
Figure 31:
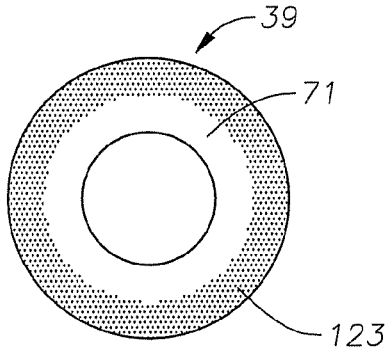
FIG. 31 is a schematic front view of an alternative embodiment of a thrust washer.
Figure 32:
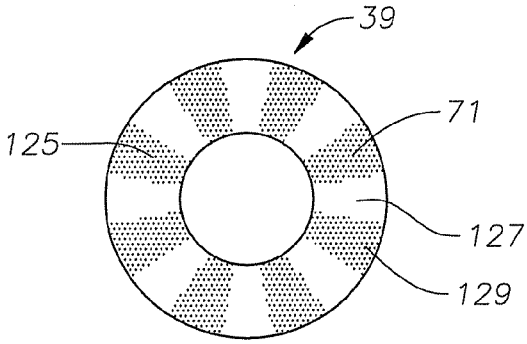
FIG. 32 is a schematic front view of an alternative embodiment of a thrust washer.
Figure 33:
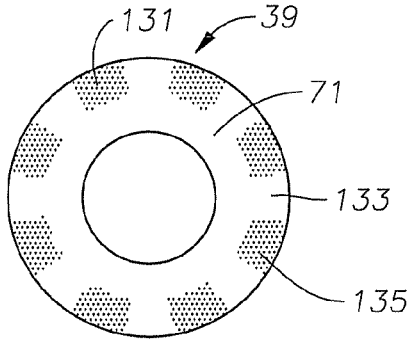
FIG. 33 is a schematic front view of an alternative embodiment of a thrust washer.

FIGS. 30 through 33, illustrate alternative embodiments of the textured surface that may be applied to side 71 of thrust washer 39. Referring to FIG. 30, in one embodiment the textured surface 121 of side 71 may cover the entire surface of side 71. In alternative embodiments, it may be more effective and economical to only partially apply surface texture 121 to only part of side 71 of thrust washer 39. Referring to FIG. 31, an alternative embodiment would be to apply textured surface 123 to side 71 in a concentric circular pattern that does not cover the complete width of side 71. Referring to FIG. 32, another alternative embodiment would be to apply textured surface 125 to side 71 in sections of the same width as side 71, around side 71 such that there are segments 127 that do not have a textured surface and segments 129 that do have a textured surface. Referring to FIG. 33, another alternative embodiment would be to apply textured surface 131 to side 71 in a broken concentric circular pattern that does not cover the complete depth of side 71 such that there are segments 133 that do not have a textured surface and segments 135 that do have a textured surface.

The shape and pattern of the textured surface shown in FIGS. 20 through 33 are for illustrative purposes only and alternative shapes and patterns may be used, such as those in FIGS. 6 through 19.

The orientation and the size and shape of the surface texture have a significant influence on its effectiveness on bearing performance. In one preferred embodiment, the grooves of the surface texture run parallel to the direction of the flow of the lubricant. This will help prevent leakage of the lubricant. In another preferred embodiment the grooves of the surface texture run perpendicular to the direction of the flow of the lubricant, which will generate extra hydrodynamic force. When considering the rotating components, the preferred embodiment would be to apply the surface texture to the rotating surface. Alternatively, when applying the surface texture to improve shock absorption, the preferred embodiment is to apply the texture to the stationary surface. A combination of different texture orientations, density, and shapes can be used in different regions of the same functional surface to maximize the lubrication performance. For example, near the edge of the journal, the long axes of the texture might be oriented along the flow direction to minimize side leakage, while in the middle region of the bearing, the long axes of the texture runs perpendicular to the flow direction to increase hydrodynamic lift force. Similarly, in area where significant impact force is expected, the texture area density might be increased.

The depth of the pattern of the textured surface may be in the range of 2-30 microns and the width or diameter of the pattern of the textured surface may be in the range of 10 to 1000 microns. The surface area of the component to which a surface texture is applied, in the width or length or both directions, can be 10% to 100% of the total functional surface area of the component. The density of the textured pattern, defined as surface area covered by the recesses of the pattern divided by the area of the component to which a surface texture is applied, may be 10% to 70%. The textured surface may be formed by mechanical cutting, embossing, chemical etching, laser engraving, electro-spark technique, vibro-chemical methods, or vibro-mechanical methods.

The effectiveness of the texture which is applied to the surface depends on the operating conditions of the bit and the clearance between the surfaces. The present invention has been described with reference to several embodiments thereof. Those skilled in the art will appreciate that the invention is thus not limited, but is susceptible to variation and modification without departure from the scope and spirit thereof.

I claim:

1. An earth-boring bit, comprising:

a bit body;

a cantilevered bearing shaft depending from the bit body and including a shaft bearing surface;

a cone assembly mounted for rotation on the bearing shaft, the cone including a mating cone bearing surface for engagement with the shaft bearing surface of the bearing shaft; and one of the bearing surfaces having a textured pattern of selectively shaped and arranged recesses formed thereon, wherein the surface area between the recesses does not have a textured pattern thereon.

2. The bit according to claim 1, wherein the textured pattern has a depth in the range from 2 to 30 microns.

3. The bit according to claim 1, wherein the textured pattern has a depth in the range from 2 to 10 microns.

4. The bit according to claim 1, wherein the recesses of the textured pattern haves a width in the range from 10 to 1000 microns.

5. The bit according to claim 1, wherein the recesses of the textured pattern haves a width in the range from 10 to 100 microns.

6. The bit according to claim 1, wherein the textured pattern has a density in the range from 10% to 70%.

7. The bit according to claim 1, wherein the bearing surfaces are journal bearing surfaces.

8. The bit according to claim 1, wherein the bearing surface is thrust bearing surfaces.

9. The bit according to claim 1, wherein the bearing surface having a textured pattern formed thereon is the shaft bearing surface.

10. The bit according to claim 1, wherein the bearing surface having a textured pattern formed thereon is the cone bearing surface.

11. An earth-boring bit, comprising:

a bit body;

a cantilevered bearing shaft depending from the bit body and including a shaft bearing surface;

a cone assembly mounted for rotation on the bearing shaft, the cone including a mating cone bearing surface for engagement with the shaft bearing surface of the bearing shaft;

one of the bearing surfaces having a textured pattern of selectively shaped and arranged recesses formed thereon wherein the surface area between the recesses does not have a textured pattern thereon;

the textured pattern having a depth in the range from 2 to 30 microns;

the recesses of the textured patterning having a width in the range from 10 to 1000 microns; and the textured pattern having a density in the range from 10% to 70%.

12. The bit according to claim 11, wherein the bearing surface having a textured pattern formed thereon is the shaft bearing surface.

13. The bit according to claim 11, wherein the bearing surface having a textured pattern formed thereon is the cone bearing surface.

14. The bit according to claim 11, wherein the bearing surfaces are journal bearing surfaces.

15. The bit according to claim 14, wherein the textured pattern covers less than 360 degrees of a circumference of the journal bearing surface.

16. The bit according to claim 14, wherein the textured pattern covers only part of an axial length of the journal bearing surface.

17. The bit according to claim 11, wherein the bearing surface is a thrust bearing surfaces.

18. The bit according to claim 17, wherein the textured pattern does not cover a total area of the thrust bearing surface.

19. An earth-boring bit, comprising:

a bit body;

a cantilevered bearing shaft depending from the bit body and including a shaft bearing surface;

a cone assembly mounted for rotation on the bearing shaft, the cone including a mating cone bearing surface for engagement with the shaft bearing surface of the bearing shaft;

one of the bearing surfaces having a textured pattern of selectively arranged recesses formed thereon, wherein the surface area between the recesses does not have a textured pattern thereon; and the textured pattern comprising elliptical shaped recesses.

20. The bit according to claim 19, wherein the elliptical shaped recesses are arranged in regularly spaceds rows and columns over the bearing surface.

21. The bit according to claim 19, wherein the elliptical shaped recesses are arranged in regularly spaceds rows and columns over the bearing surface and the long axes of the elliptical shaped recesses of adjacent rows do not coincide.

22. The bit according to claim 19, wherein the long axes of the elliptical shaped recesses are not perpendicular to a first edge of the bearing surface and the long axes of the elliptical shaped recesses are not parallel to the first edge of the bearing surface.

* * * * *

UNITED STATES PATENT AND TRADEMARK OFFICE

CERTIFICATE OF CORRECTION

PATENT NO. : 7,559,381 B2
APPLICATION NO. : 11/760892
DATED : July 14, 2009
INVENTOR(S) : Chih C. Lin It is certified that error appears in the above-identified patent and that said Letters Patent is hereby corrected as shown below:

Column 8, line 29, delete “haves” and insert --have--
Column 8, line 32, delete “haves” and insert --have--
Column 8, line 39, after “is” insert --a-- and delete “surfaces” and insert --surface--
Column 8, line 57, after “thereon” insert a --,--
Column 10, line 11, delete “spaceds” and insert --spaced--
Column 10, line 14, delete “spaceds” and insert --spaced--

Signed and Sealed this

First Day of December, 2009

David J. Kappos

David J. Kappos
*Director of the United States Patent and Trademark Office*